US006799401B1

(12) United States Patent
Legler

(10) Patent No.: US 6,799,401 B1
(45) Date of Patent: Oct. 5, 2004

(54) HOLLOW POLE ANCHORING SYSTEM

(75) Inventor: Stefan Legler, Herdman (CA)

(73) Assignee: Tri-Steel Industries Inc., Montreal (CA)

( * ) Notice: Subject to any disclaimer, the term of this patent is extended or adjusted under 35 U.S.C. 154(b) by 0 days.

(21) Appl. No.: 10/400,563

(22) Filed: Mar. 28, 2003

(51) Int. Cl.[7] ..... E02D 5/74
(52) U.S. Cl. ..... 52/169.13; 52/297; 52/726.3
(58) Field of Search ..... 52/169.13, 170, 52/297, 726.3, 726.4

(56) References Cited

U.S. PATENT DOCUMENTS 693,947 A * 2/1902 Bunce ..... 52/297
854,489 A * 5/1907 Gribben ..... 52/169.13
3,137,098 A * 6/1964 Elia et al. ..... 52/170
3,514,911 A * 6/1970 Preradovich ..... 52/165
3,544,110 A * 12/1970 Dickinson ..... 52/726.3
4,218,858 A 8/1980 Legler
4,558,545 A * 12/1985 Lindner ..... 52/169.13
5,133,164 A 7/1992 Legler

* cited by examiner

*Primary Examiner*—Peter R. Brown
(74) *Attorney, Agent, or Firm*—Ogilvy Renault; Guy J. Houle

(57) ABSTRACT

A pole anchoring system for supporting a hollow distribution pole vertically over a hard support surface, such as rock, concrete or the like is described. The anchoring system comprises a solid plug of predetermined length and diameter adapted for close fit in a lower section of a hollow distribution pole. A harness assembly is connected about the lower section of the hollow distribution pole by connectors. The harness assembly has at least three anchor bolt restraining guides which are vertically spaced-apart about the harness assembly for captively receiving an upper portion of an anchor bolt of an anchor bolt assembly in each of the restraining guides. The anchor bolt assembly has a lower anchoring section and an upper anchor actuation section.

12 Claims, 3 Drawing Sheets

HOLLOW POLE ANCHORING SYSTEM

TECHNICAL FIELD

The present invention relates to a pole anchoring system for supporting hollow poles, such as electrical distribution poles, vertically over a hard support surface, such as rock, concrete or the like.

BACKGROUND ART

It is known to anchor solid wooden poles vertically over a hard surface such as rock, concrete or the like by securing a harness about the lower portion of the pole and providing anchoring bolts which extend into the ground and secured to the harness whereby to hold the pole vertically over the hard surface. Such systems are described in my earlier U.S. Pat. Nos. 4,218,858 and 5,133,164. These anchoring devices have been primarily used for anchoring small diameter wooden poles such as telephone poles. However, with very large diameter hollow poles reaching heights of 50 feet or more, and top loaded with electrical wires, the anchoring system would be subjected to a lot of stress due to pole deflection loads often in the range of 5 to 20 degrees. Because of such stresses transmitted to the anchoring system, it has not been feasible to adapt these anchoring systems for supporting hollow metal distribution poles as such deflection in the poles would cause the hollow pole to buckle locally or to experience local buckling at its attachments with the harness assembly and the load would eventually cause the entire pole and possibly adjacent poles to bend or break and fall or be suspended by the electrical wires connected to adjacent poles.

A further disadvantage of adapting such anchoring system to hollow metal distribution poles is that these poles are usually constructed as hollow cylindrical poles and the thickness of the side wall of the pole is very thin, usually in the range of 1/16 inch to about 1/4 inch maximum. Adapting a harness assembly about such poles would require drilling into the harness and into the pole and inserting large tapping bolts to make a connection between the harness and the pole. Because these poles are subjected to vibration during high wind loads, the constant vibration or movement in the pole could cause these fasteners to wear and eventually release.

A still further disadvantage of using hollow metal poles is that the load bearing surface at the bottom of the pole is extremely small and is constituted by the surface contact area of the circumferential wall of the pole which is usually less than 10 percent of the diameter of the pole at its bottom end.

SUMMARY OF INVENTION

It is a feature of the present invention to provide a pole anchoring system for supporting a hollow distribution pole and which substantially overcomes the above-mentioned disadvantages.

Another feature of the present invention is to provide a pole anchoring system and wherein a solid plug is disposed in close fit in a lower section of the distribution pole to increase its rigidity at its bottom end section, and to increase its load bearing surface as well as permitting a rigid connection with a harness and bolt anchoring system.

According to the above features, from a broad aspect, the present invention provides a pole anchoring system for supporting a hollow pole vertically over a hard support surface, such as rock, concrete or the like. The anchoring system comprises a solid plug of predetermined length and diameter and adapted for close fit in a lower section of the hollow distribution pole. A harness assembly is connected about the lower section of the hollow distribution pole by connecting means. The harness assembly has at least three anchor bolt restraining guide means vertically spaced apart about the harness assembly for captively receiving an upper portion of an associated anchor bolt of an anchor bolt assembly in each of the restraining guide means. The anchor bolt assembly has a lower bolt anchoring section and an upper bolt anchor actuation means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
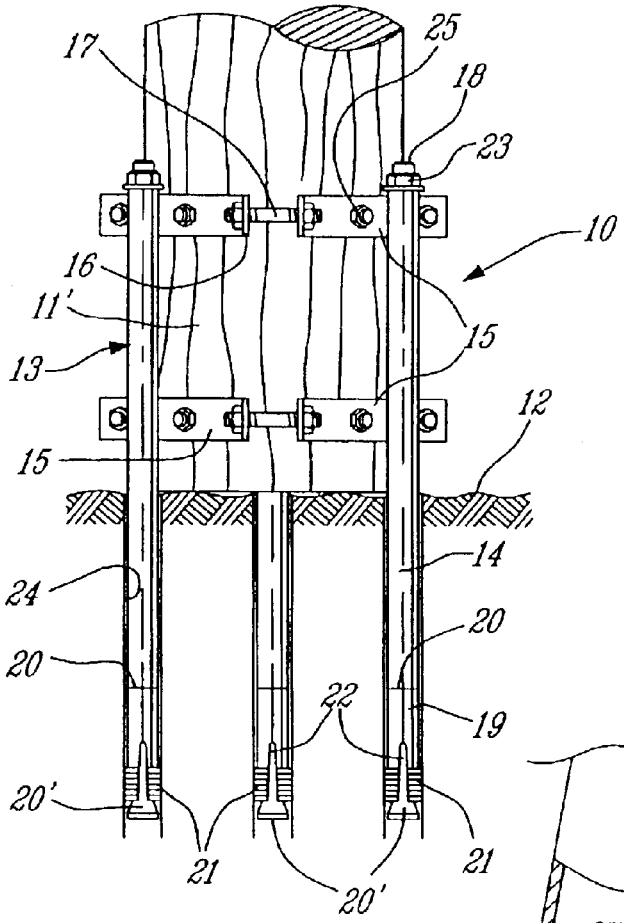
Fig. 1A (PRIOR ART)
FIG. 1A is a side view, partly fragmented, showing a pole anchoring system of the prior art.

Referring now to FIG. 1A, there is shown a pole anchoring system 10 for anchoring a wooden pole 11 on a solid ground surface 12. The solid ground surface 12 could be a concrete surface, it could be solid rock or the like hard ground surfaces. As hereinshown, three harness assemblies 13 are secured about the bottom end portion or section 11' of the pole 11. Each harness assembly 13 consists of harness sections, each having a hollow metal tube 14 provided with a pair of spaced-apart clamping flanges 15 welded thereto. The flanges 15 have curved flange sections 15' extending on opposed sides of its hollow metal tube 14. The ends of the flange sections 15' have a connecting flange 16 for interconnecting the harness sections together by connecting bolts 17.

As can be seen, the harness section further has an elongated actuating bolt 18 extending through the hollow metal tube 14 and through an expansion shell 19 disposed in abutment with a lower edge 20 of the hollow metal tube 14. The actuating bolt 18 has a conical bottom end 20'. The expansion shell has gripping ridges 21 in a lower portion thereof and has a slit 22 extending through these ridges whereby after the harness is rigidly secured about the lower section of the pole, any translationary upward movement of the bolt by threading the nut 23 about a threaded upper end of the bolt 18, causes the bolt to be pulled upwardly thereby causing the expansion shell to expand at its gripping ridges and rigidly interconnect with the surrounding surface of the bore hole 24 whereby to solidly anchor the harness assembly and the lower portion of the pole in the solid ground surface 12. As can be seen, the curved flange sections 15' also have holes therein to receive lag bolts 25 which are driven into the wooden plug or screwed into the plug to provide a solid connection with the wooden plug.

Figure 1B:
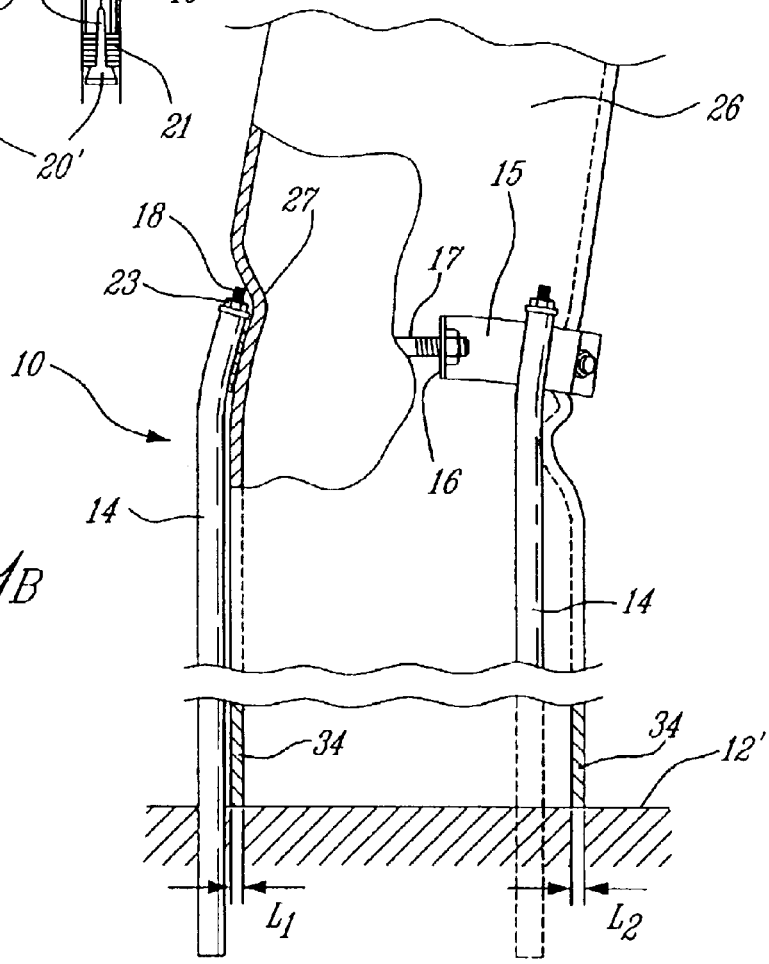
FIG. 1B is a partly fragmented side view showing the disadvantage of adapting the pole anchoring system of FIG. 1 to hollow metal poles.

If the harness assembly 10 of the prior art is to be connected to hollow metal poles, as shown in FIG. 1B, this would cause the hollow metal pole 26 to experience local buckling in the area 27 where it is connected to the flanges of the harness assembly, as the hollow metal pole does not have sufficient strength to resist to lateral loads. If the metal pole did not have the plug 30 in its lower end, then when disposed on a solid ground surface 12' such as a rock surface, the only load bearing surface of the pole with the surface 12' would be the width of the circumferential side wall 34 of the pole. This load bearing area over the diameter of the pole is illustrated herein as being constituted by the distance L1 and L2 which is equal to the thickness of the pole side wall along the diameter. It can therefore be seen that this bearing surface area is much inferior to 10 percent of the pole diameter. With the plug 30, the bearing surface is increased to substantially the entire diametrical surface of the pole and plug. Accordingly, all of the vertical load in the hollow pole is now supported across the entire diameter of the pole. Further, without the plug the harness would cause the pole to buckle, as herein illustrated. The load on the hollow pole could also cause the pole to break at its buckled area which would usually take place along the upper flanges 15 of the harness assembly 13. Repairing such damage would be very costly. Accordingly, expensive foundations must be used to support such hollow poles on rocky soil or else wooden pole structures are used and these are unsightly, have a shorter expected useful life and less environmentally friendly.

Figure 4:
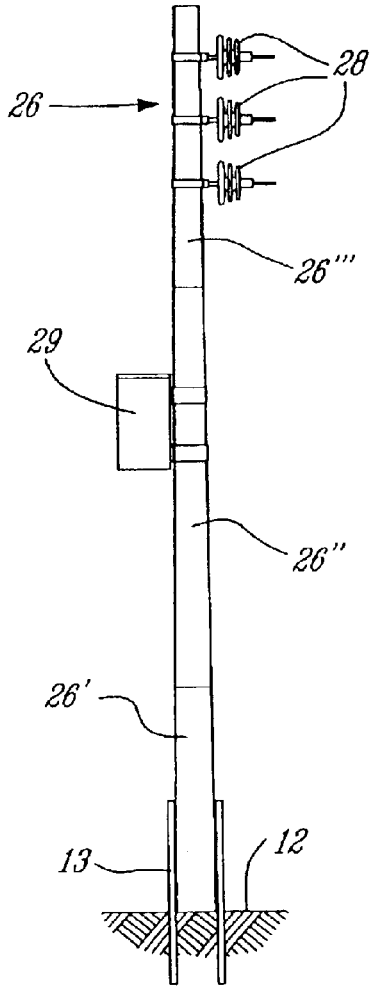
FIG. 4 is a schematic view showing a hollow distribution pole of the present invention and supported by the anchoring system of the present invention.

FIG. 4 illustrates such an electrical metal distribution pole wherein the pole 26 may be formed of three sections 26', 26" and 26'" which are interconnected together end-to-end. These poles are also provided with electrically insulated wire supports 28 to which electrical distribution wires are connected. Transformers 29 may also be attached to such poles. Accordingly, it can be seen that this heavy weight of wires along the top end of the pole could transmit a lot of stress on its bottom end connection. Some of these poles can have heights of at least 50 fee high and may often support six electrical distribution lines which are very heavy wires.

Figure 2:
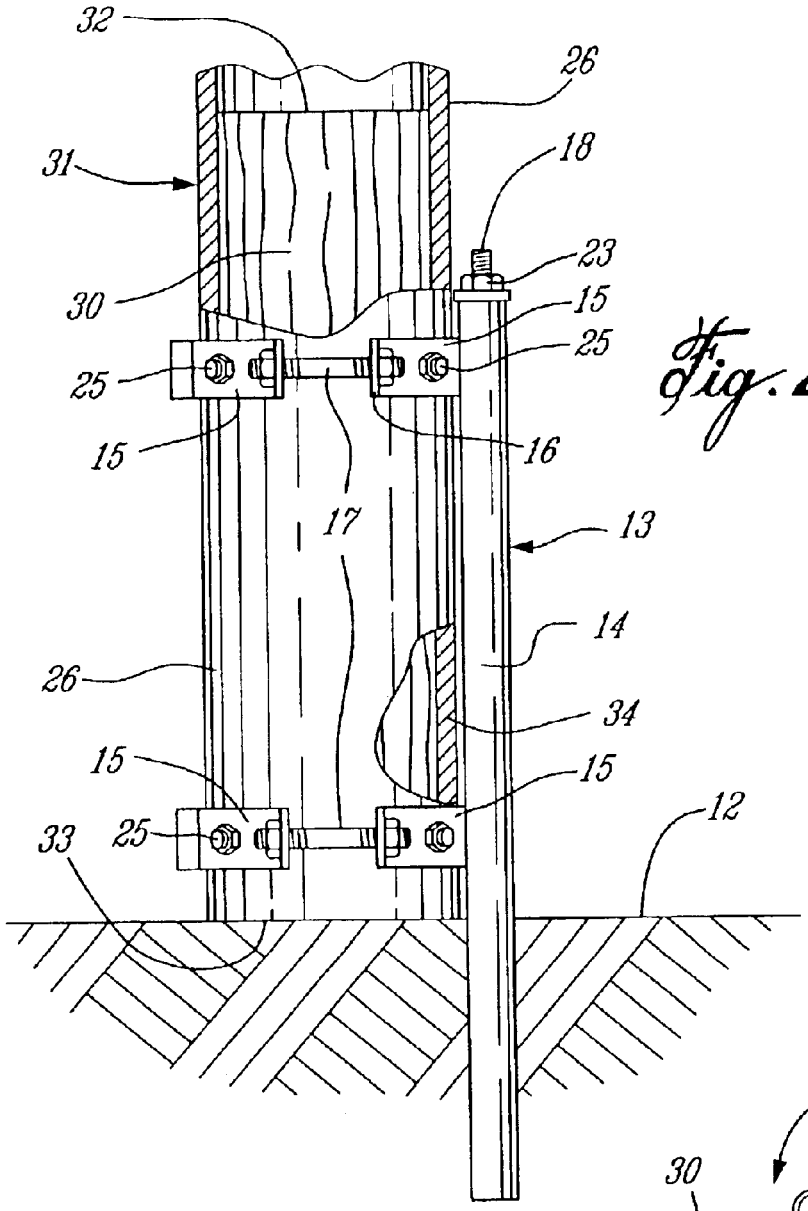
FIG. 2 is a fragmented side view showing the pole anchoring system of the present invention for supporting a hollow distribution pole vertically over a hard support surface and wherein a solid plug is disposed in close fit in a lower section of the hollow distribution pole.
Figure 3:
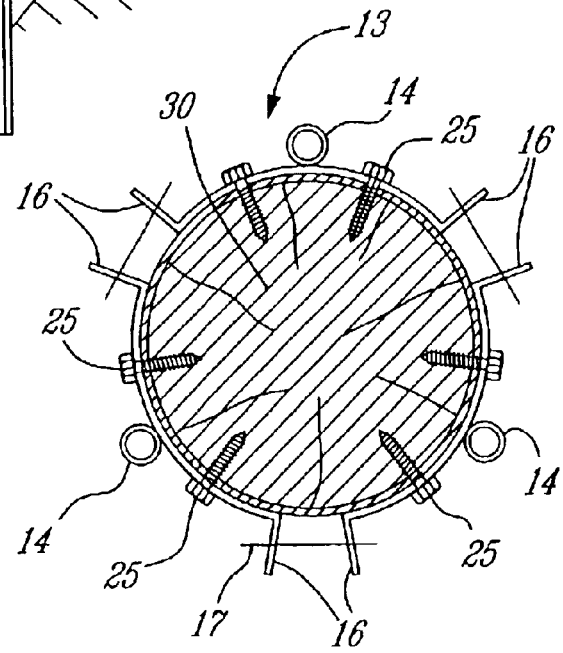
FIG. 3 is a cross-section view of the hollow pole of FIG. 2.

In order to overcome the problem as illustrated in FIG. 1B, and in order to utilize these hollow metal distribution poles over hard ground surface, the present invention provides for a solid plug 30, herein a wooden plug, having a predetermined length and a predetermined diameter for close fit in a lower section 31 of the hollow metal pole 26. As shown in FIG. 2, the predetermined length is delineated by the upper end 32 of the pole and it extends beyond the upper clamping flange 15 of the harness assemblies 13. The solid plug has a flat bottom end 33 to provide a load bearing surface when the hollow distribution pole is secured on the solid support surface 12. As hereinshown the plug 30 is a solid wooden plug and its diameter is shaped for close fit within the hollow metal pole 26. The plug 30 also permits for the harness assemblies to be positively secured to the lower end of the hollow metal pole by lag bolts 25. To penetrate the circumferential wall 34 of the hollow pole, holes are drilled therethrough and the lag bolts are either screwed into the plug or driven into the plug. In the case where the plug could be constructed of casted concrete, thin through bores could be drilled into the concrete to receive an expansion sleeve to secure lag bolts thereinto. It is further conceivable that the hollow poles may be made of fiberglass or structural plastics rather than metal.

Figure 6:
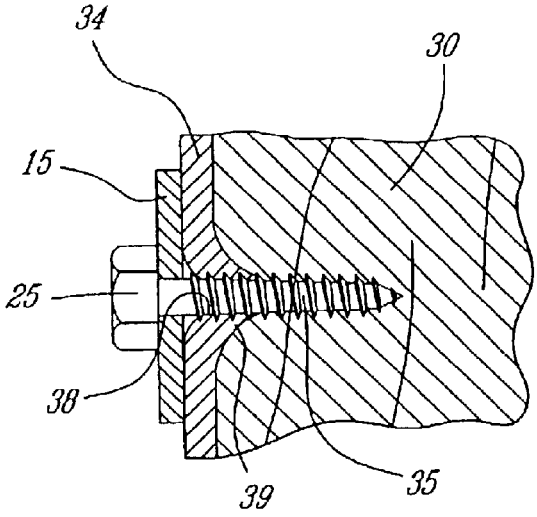
FIG. 6 is a fragmented section view showing a lag bolt interconnecting the harness assembly to the wooden plug of a hollow metal distribution pole.

Referring to FIG. 6, it can be seen that the holes 38 which are drilled into the side wall 34 of the metal pole for securing the lag bolts 25 are preferably smaller in diameter whereby when the lag bolt 25 is driven therethrough, it will cause the metal about the hole 38 to form inner knurls 39 which will engage within the wooden plug 30 whereby to provide a more positive connection between the harness assembly and the lower section of the pole.

In my two earlier patents referred to herein, it can be seen that the harness assemblies are differently constructed. It is therefore within the ambit of the present invention not to limit the anchoring system to that as specifically illustrated therein, but such an assembly needs to be connected about the lower section of the hollow distribution pole and into the hard ground surface. The harness assembly should have at least three anchor bolt restraining guide means which are vertically spaced-apart about the harness assembly for captively receiving an upper portion of anchor bolts of an anchor bolt assembly. The anchor bolt assembly also has a lower anchoring section, which may be constructed differently than that illustrated herein and the upper anchoring actuation means could also be differently constructed than the one illustrated herein.

Figure 5:
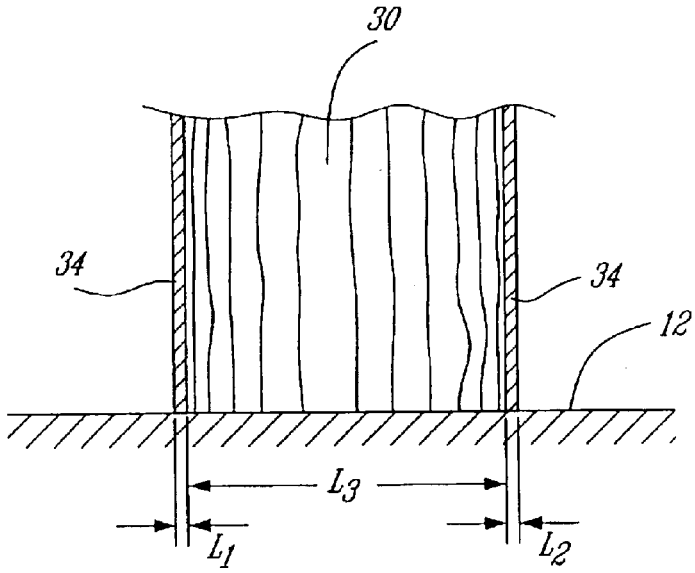
FIG. 5 is a fragmented section view of the lower end of the hollow distribution pole illustrating its total ground bearing surface as compared to the pole of FIG. 1B.

As shown in FIG. 5, by providing a solid plug 30 in the lower end section of the hollow metal pole, the bearing surface area has been increased to substantially 100 percent ground bearing. Such anchoring system for hollow distribution poles now permits the use of clamping harness assemblies as illustrated in the drawings and in my earlier patents. These solid plugs 30 can also be manufactured from leftover or defective wooden poles wherein sections thereof are salvageable. The advantage of using hollow metal poles is that they can be made of sections, they are lighter to transport than solid wooden poles, can be constructed at greater heights, and provide for a cleaner environment. They are less polluting than treated wooden poles and now they can be used over hard surfaces such as rocky terrain.

Although we have herein described the use of the plug 30 with hollow electrical distribution poles, the present invention should not be limited thereto as it is feasible to adapt the invention to lighting poles, flag poles and other types of hollow poles.

It is within the ambit of the present invention to cover any obvious modifications of the preferred embodiment described herein, provided such modifications fall within the scope of the appended claims.

I claim:

1. A pole anchoring system for supporting a hollow pole vertically on a hard support surface, such as rock, concrete or the like, said anchoring system comprising a solid plug of predetermined length and diameter adapted for close friction fit in a lower section of said hollow distribution pole, said solid plug having a flat bottom end to provide a load bearing surface when said hollow pole is secured on said hard support surface, a harness assembly connected about said lower section of said hollow distribution pole by connecting means, said connecting means having fasteners which extend through said hollow pole and into said solid plug, said harness assembly having at least three anchor bolt restraining guide means spaced apart about said harness assembly for captively receiving an upper portion of an associated anchor bolt of an anchor bolt assembly in each said restraining guide means, said anchor bolt assembly having a lower bolt anchoring section and an upper bolt anchor actuation means.

2. A pole anchoring system as claimed in claim 1 wherein said solid plug is a solid wood plug.

3. A pole anchoring system as claimed in claim 2 wherein said harness assembly has at least three clamping sections, each clamping section having one of said bolt restraining guide means, said clamping sections having a curved clamping wall provided with interconnecting means to clampingly secure said clamping wall of said clamping sections together about said lower section of said hollow pole.

4. A pole anchoring system as claimed in claim 3 wherein said clamping walls are provided with through bores for receiving said fasteners therethrough and through a further bore in said wall of said hollow pole adjacent said lower section of said pole whereby a securing end portion of said fasteners may be secured in said solid plug, said fasteners being lag bolts, said further bore in said wall of said pole has a smaller diameter than the diameter of the lag bolts whereby metal about said further bore will form inner knurls to engage in said wooden plug when a bolt is driven through said further bore.

5. A pole anchoring system as claimed in claim 4 wherein said securing end portion of said lag bolt is driven into said solid plug.

6. A pole anchoring system as claimed in claim 4 wherein said securing end portion of said lag bolt is threaded into said solid plug.

7. A pole anchoring system as claimed in claim 1 wherein said solid plug is a casted concrete plug.

8. A pole anchoring system as claimed in claim 3 wherein said interconnecting means is comprised by interconnecting bolts, said bolts securing connecting flanges of adjacent curved clamping walls, said solid plug preventing buckling of said hollow distribution pole in said lower section thereof when subjected to lateral loads.

9. A pole anchoring system as claimed in claim 1 wherein said hollow pole is one of a hollow metal pole, a hollow fiberglass pole or a hollow structural plastic pole.

10. A pole anchoring system as claimed in claim 1 wherein said predetermined length of said solid plug is predetermined whereby said plug extends within said hollow pole beyond a top end of said harness assembly.

11. A pole anchoring system as claimed in claim 1 wherein said upper anchor actuation means is constituted by an actuation nut threaded about an upper threaded section of said bolt and disposed for abutting engagement with said bolt restraining guide means to actuate a bolt anchor at a lower end of said bolt in a bore hole drilled in said hard support surface.

12. A pole anchoring system as claimed in claim 1 wherein said hollow pole is one of an electrical distribution pole, a lighting pole, a flag pole or other types of hollow poles.

* * * * *